US011957193B2

(12) United States Patent
Kishineff

(10) Patent No.: US 11,957,193 B2
(45) Date of Patent: Apr. 16, 2024

(54) LOAD-ASSISTING GLOVE

(71) Applicant: Mark Kishineff, Lincoln City, OR (US)

(72) Inventor: Mark Kishineff, Lincoln City, OR (US)

( * ) Notice: Subject to any disclaimer, the term of this patent is extended or adjusted under 35 U.S.C. 154(b) by 620 days.

(21) Appl. No.: 17/204,492

(22) Filed: Mar. 17, 2021

(65) Prior Publication Data

US 2021/0289856 A1 Sep. 23, 2021

Related U.S. Application Data

(60) Provisional application No. 62/991,464, filed on Mar. 18, 2020.

(51) Int. Cl.
*A41D 19/00* (2006.01)
*A45F 5/00* (2006.01)

(52) U.S. Cl.
CPC ..... *A41D 19/0037* (2013.01); *A45F 5/00* (2013.01); *A41D 2600/20* (2013.01); *A45F 2005/008* (2013.01)

(58) Field of Classification Search
CPC ..... A41D 19/0037; A41D 2600/20; A45F 2005/008; A45F 5/00
USPC ..... 294/25
See application file for complete search history.

(56) References Cited

U.S. PATENT DOCUMENTS 1,322,027 A 11/1919 Lacaire
1,664,804 A 4/1928 Allen
2,294,997 A 9/1942 Merrion
4,247,097 A * 1/1981 Schwartz ..... A63B 21/065 2/160
4,345,368 A * 8/1982 Goss ..... H05B 3/56 338/214
4,447,912 A * 5/1984 Morrow ..... A61F 4/00 2/160
4,730,354 A * 3/1988 Saito ..... A63B 71/146 2/161.4

(Continued)

FOREIGN PATENT DOCUMENTS

EP 2106710 A1 10/2009
EP 2361518 A2 8/2011

OTHER PUBLICATIONS

Manex Radial Hand Splint, https://www.handtherapyproducts.com/products/manex-radial-hand-splint-black.

(Continued)

*Primary Examiner* — Paul T Chin

(57) ABSTRACT

A load-assisting glove is an apparatus that assists users with the load from a handheld tool such as a shovel. The apparatus may include a work glove and a bracing socket. The work glove maintains the bracing socket at an ergonomic position adjacent to the user's arm. The bracing socket lessens the amount of grip needed to work with the handheld tool. The work glove includes a wrist opening, a palmar portion, and a dorsal portion. The wrist opening enables the user to put on the work glove. The palmar portion protects the palmar area of the hand, while the dorsal portion protects the dorsal area. The bracing socket includes an open socket end and a closed socket end. The open socket end enables the end of the tool handle to be inserted into the bracing socket, while the closed socket end keeps the handle end within the bracing socket.

16 Claims, 10 Drawing Sheets

(56) References Cited

U.S. PATENT DOCUMENTS

| | | | | | |
|---|---|---|---|---|---|
| 4,793,005 | A | * | 12/1988 | Hetzel, Jr. | A41D 19/01547 482/106 |
| 5,004,231 | A | * | 4/1991 | Alread | A63B 21/4021 482/106 |
| 5,353,440 | A | * | 10/1994 | Meldeau | A41D 19/01547 2/161.1 |
| 5,638,548 | A | | 6/1997 | Kawakami | |
| 5,878,438 | A | * | 3/1999 | Ragsdale | A41D 19/01 2/160 |
| 5,887,282 | A | | 3/1999 | Lenhart | |
| 6,199,211 | B1 | * | 3/2001 | Franzolino | A41D 13/082 128/878 |
| 6,564,389 | B1 | | 5/2003 | Laughlin | |
| 6,810,531 | B1 | | 11/2004 | Lento | |
| 9,155,951 | B2 | * | 10/2015 | Ahern | A63B 69/0059 |
| 10,062,364 | B1 | * | 8/2018 | Amaral | A45F 5/00 |
| 2010/0145474 | A1 | | 6/2010 | Duncan | |
| 2019/0289933 | A1 | | 9/2019 | Kinsora | |

OTHER PUBLICATIONS

Magicmend Schedule 40 Pipe Extender, https://www.acehardware.com/departments/plumbing/pipe-fittings/plastic-fittings/4512554.

* cited by examiner

LOAD-ASSISTING GLOVE

The current application claims a priority to the U.S. Provisional Patent application Ser. No. 62/991,464 filed on Mar. 18, 2020.

FIELD OF THE INVENTION

The present invention generally relates to work articles and body support accessories. More specifically, the present invention provides a work glove with load-assisting capabilities to aid users with handheld tools.

BACKGROUND OF THE INVENTION

Many work-related injuries are caused by poor or inappropriate use of handheld tools. For example, many workers are treated for injuries that happened while shoveling or manually moving bulk materials such as soil, coal, gravel, snow, sand, or ore. Some types of injuries resulting from shoveling can include sprains and strains, particularly in the back and shoulders, due to the load being unevenly carried by the user. Other injuries include lacerations and finger amputations caused by mishandling of the handheld tools. With the high stress and the high risk of injuries on the user's hands, it is important for the user to wear appropriate gloves.

There are many types of work gloves currently available in the market designed to better protect the user's hands. For example, many manufacturers are producing cut-resistant gloves that provide greater dexterity to the user while protecting the user's hands from cuts. In addition, many work gloves are made with anti-slip material that increases the grip and prevents the tools from slipping off the user's hands. However, these work gloves provide little to no support to help with the load of the handheld tools on the user's body. Thus, there is a need for gloves with safety features that provide support while handling handheld tools to minimize the load on the user's body.

SUMMARY OF THE INVENTION

The present invention is a load-assisting glove that addresses the problems associated with existing work safety gloves. The load-assisting glove provides convenient means to minimize the load on the user's body from the handheld tools while incorporating other safety features that protect the user's hands. The load-assisting glove includes a bracing socket designed to receive the end of the handle of a handheld tool such as a shovel, broom, etc. The bracing socket is designed to take some of the load from the hand to minimize strain on the user's body and prevent injuries or even permanent damage to the user's body. Additional features and benefits are further discussed in the sections below.

DETAILED DESCRIPTION OF THE INVENTION

All illustrations of the drawings are for the purpose of describing selected versions of the present invention and are not intended to limit the scope of the present invention.

The present invention is a load-assisting glove that assists users with the load being carried using a handheld tool such as a shovel, broom, or the like. As can be seen in FIG. 1 through 4, the present invention may comprise a work glove 1 and a bracing socket 5. The work glove 1 maintains the bracing socket 5 at an ergonomic position adjacent to the user's forearm while also protecting the user's hand. The work glove 1 also facilitates the handling of the handheld tool while minimizing the stress on the user's hand. The bracing socket 5 receives the end of the tool handle to minimize the load on the user's body when operating the handheld tool. In addition, the bracing socket 5 lessens the amount of grip needed to work with the handheld tool.

Figure 1:
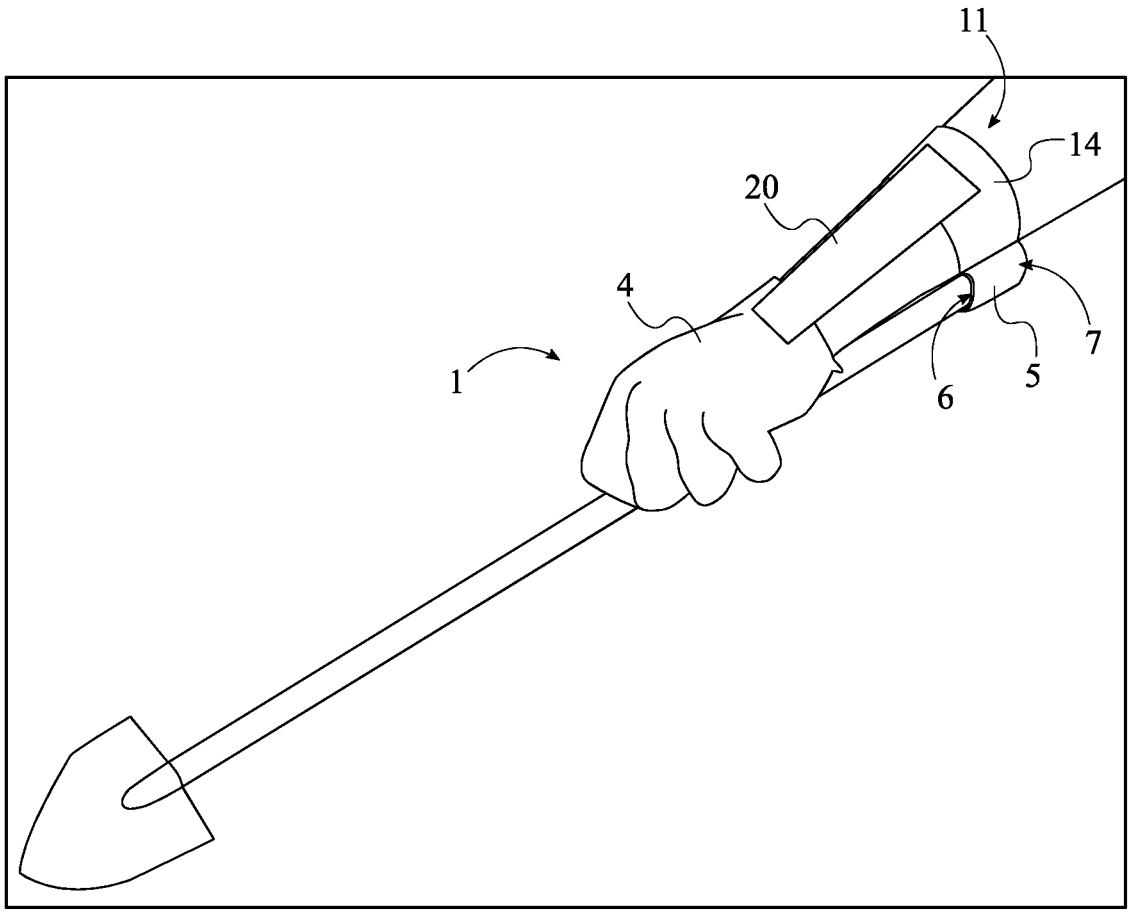
FIG. 1 is a schematic view showing the present invention being worn on a user's hand, wherein the user's hand is shown handling a shovel.
Figure 10:
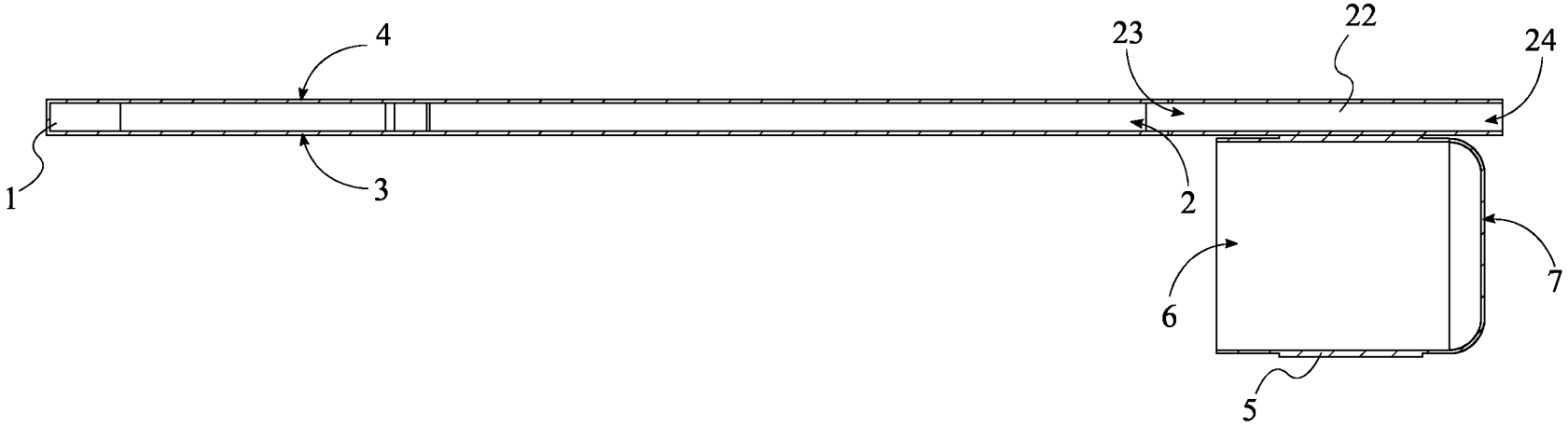
FIG. 10 is a cross-sectional view taken along the line 10-10 in FIG. 9.

The general configuration of the aforementioned components enables the user to work more efficiently and safely without overstraining or injuring their body. As can be seen in FIG. 1, the work glove 1 is preferably a glove made from materials specifically chosen to meet certain standards and regulations. For example, the work glove 1 can be made from fire-retardant material, insulating material, cut-resistant material, etc. The work glove 1 comprises a wrist opening 2, a palmar portion 3, and a dorsal portion 4. The wrist opening 2 enables the user to insert the hand to put on the work glove 1. The palmar portion 3 braces the palmar area of the hand, while the dorsal portion 4 braces the dorsal area of the hand. Moreover, the bracing socket 5 is preferably an open-ended hollow structure with a size and cross-sectional shape designed to receive the end of the tool handle. The bracing socket 5 can be made from solid material such as polyvinyl (PVC) material or from flexible material such as fabric or leather that is tear resistant. As can be seen in FIG. 10, the bracing socket 5 comprises an open socket end 6 and a closed socket end 7. The open socket end 6 enables the end of a tool handle to be inserted into the bracing socket 5. The closed socket end 7 keeps the end of the tool handle within the bracing socket 5 to receive the partial load from the handheld tool.

Figure 2:
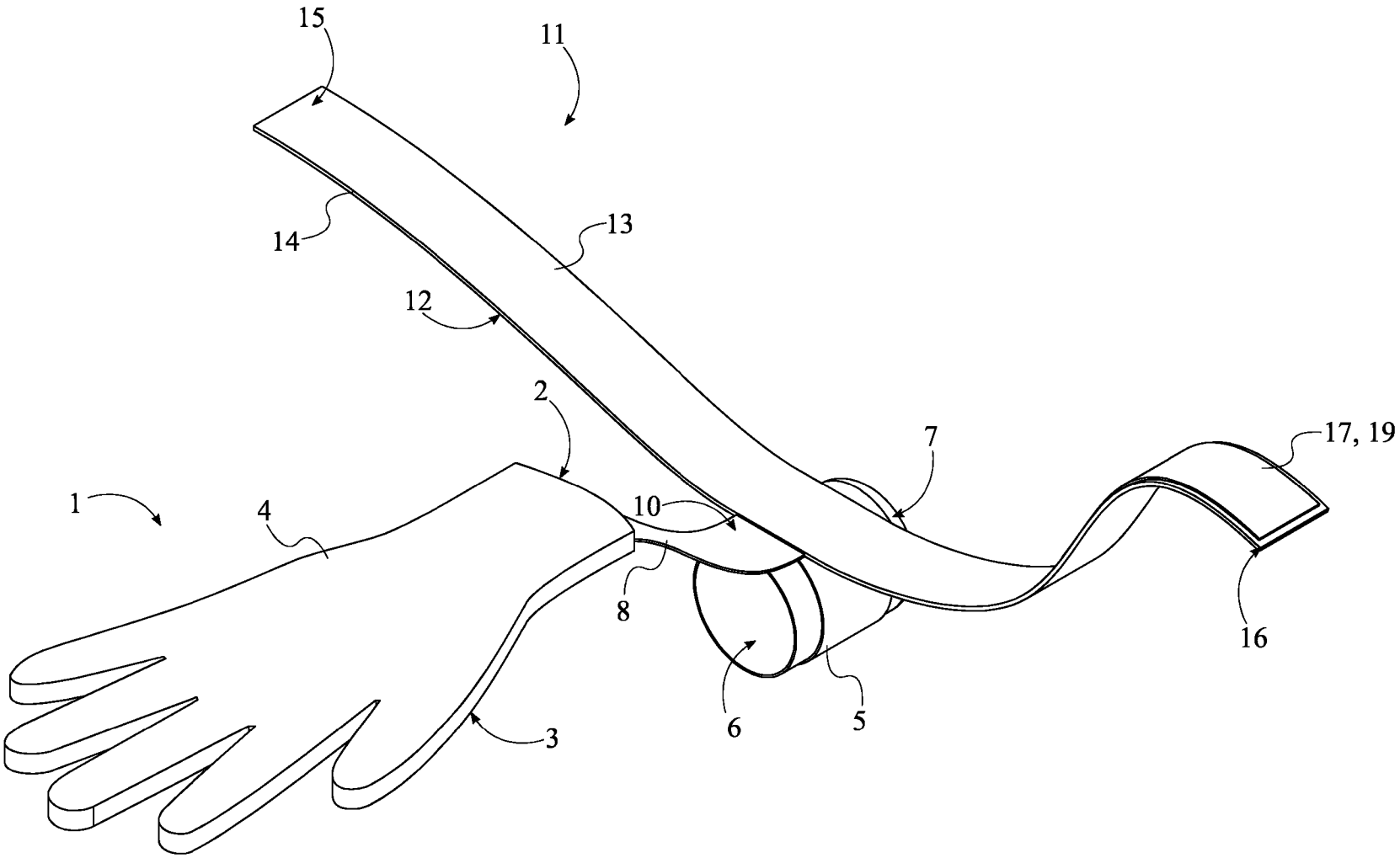
FIG. 2 is a top-front perspective view showing the present invention, wherein the armband is shown unfastened.
Figure 3:
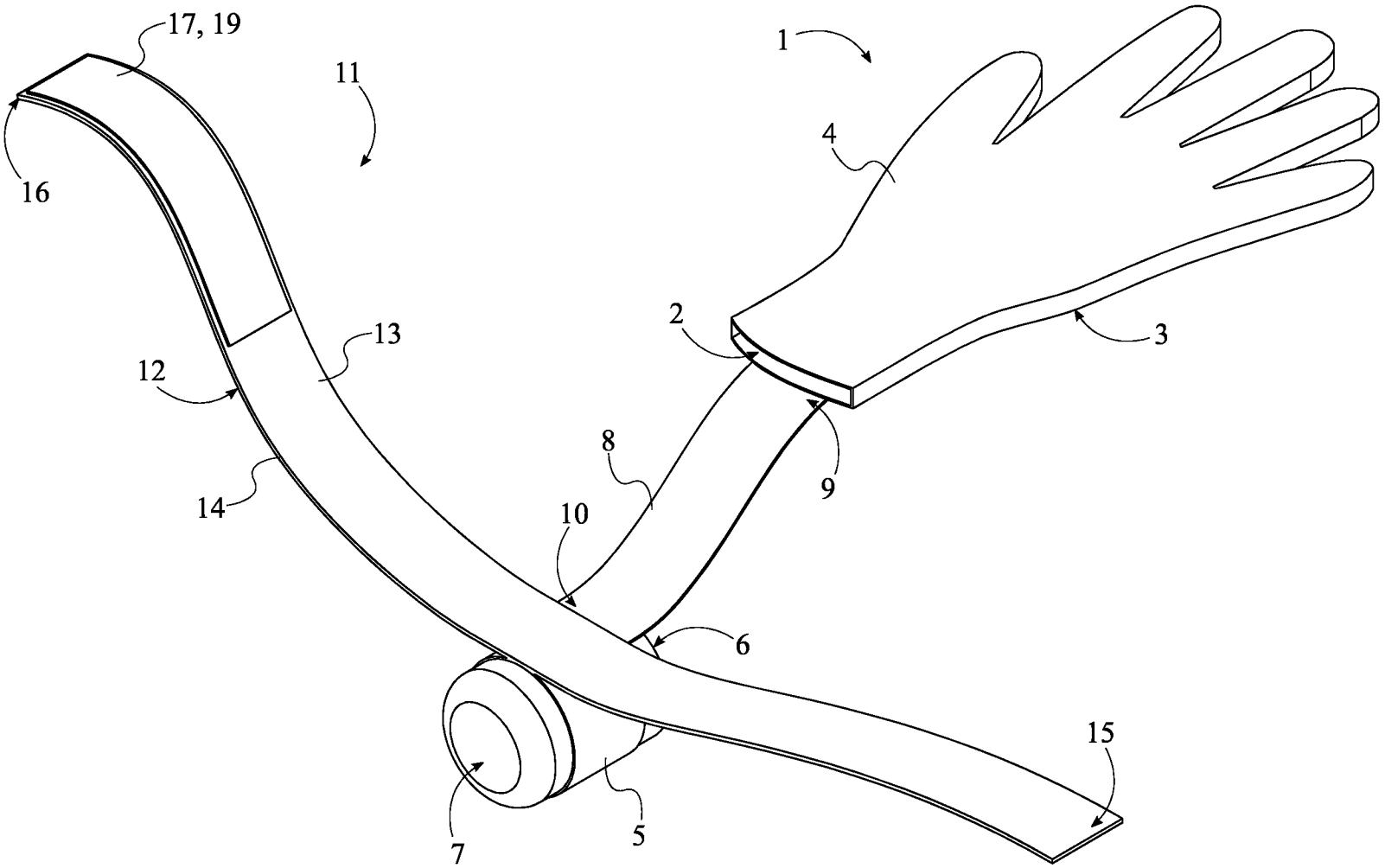
FIG. 3 is a top-rear perspective view showing the present invention.
Figure 4:
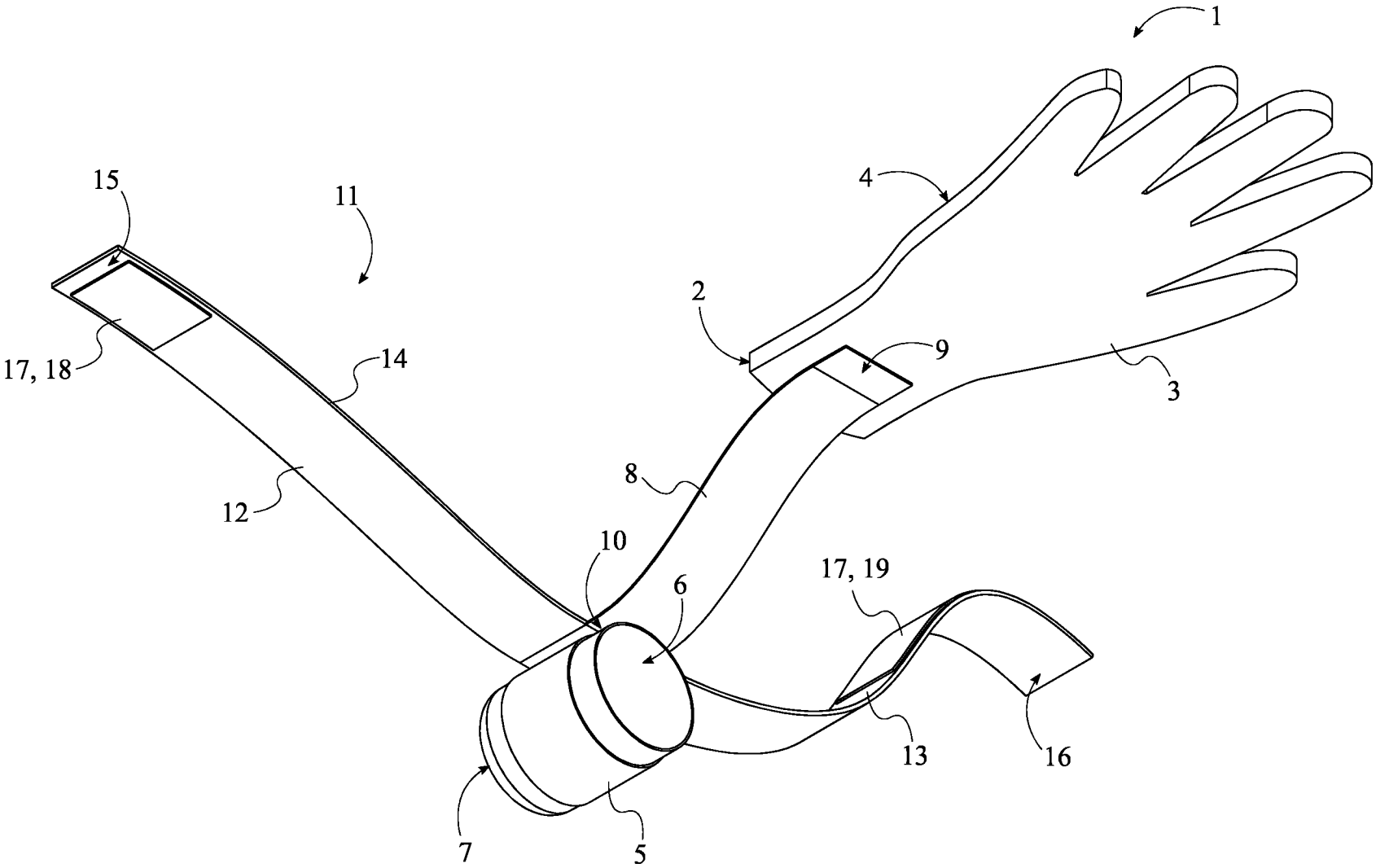
FIG. 4 is a bottom-front perspective view showing the present invention.

As can be seen in FIG. 2 through 4, the palmar portion 3 is positioned opposite to the dorsal portion 4 about the work glove 1 to form the hollow structure of the work glove 1 that matches the shape of the user's hand. The wrist opening 2 is positioned in between the dorsal portion 4 and the palmar portion 3. The positioning of the wrist opening 2 ensures that the user's hand is positioned in between the dorsal portion 4 and the palmar portion 3 as the hand is being inserted through the wrist opening 2. Further, the bracing socket 5 is mounted offset from the wrist opening 2, opposite the dorsal portion 4, so that the end of the tool handle is positioned against the user's forearm. By positioning the end of the tool handle offset from the hand, some of the load normally carried by the user's hand is passed to the rest of the arm. Moreover, the open socket end 6 is oriented towards the work glove 1 so, when the end of the tool handle is inserted into the bracing socket 5, the tool handle is positioned against the palmar portion 3. Consequently, the closed socket end 7 is oriented away from the work glove 1 to keep the tool handle positioned against the palmar portion 3.

To maintain the bracing socket 5 connected to the work glove 1, the present invention may further comprise an offsetting strap 8. As can be seen in FIG. 2 through 4, the offsetting strap 8 is preferably an elongated strap that maintains the bracing socket 5 at a distance away from the work glove 1. The offsetting strap 8 may be made from different flexible materials that do not easily tear nor stretch. In addition, the offsetting strap 8 has a length designed to keep the bracing socket 5 at an optimal distance along the user's forearm to minimize the strain on the user's body. The bracing socket 5 is tethered to the work glove 1 by the offsetting strap 8, thus always keeping the bracing socket 5 connected to the work glove 1. In addition, the offsetting strap 8 may comprise a first strap end 9 and a second strap end 10 corresponding to the terminal ends of the elongated strap structure. The first strap end 9 is positioned opposite to the second strap end 10 along the offsetting strap 8 due to the length of the offsetting strap 8. Further, the first strap end 9 is externally connected onto the palmar portion 3 to secure the offsetting strap 8 to the work glove 1. In addition, the second strap end 10 is laterally connected to the bracing socket 5, which prevents interference by the offsetting strap 8 from receiving the end of the tool handle with the bracing socket 5. In other embodiments, the offsetting strap 8 can be replaced with other tethering devices such as strings, cords, etc.

Figure 5:
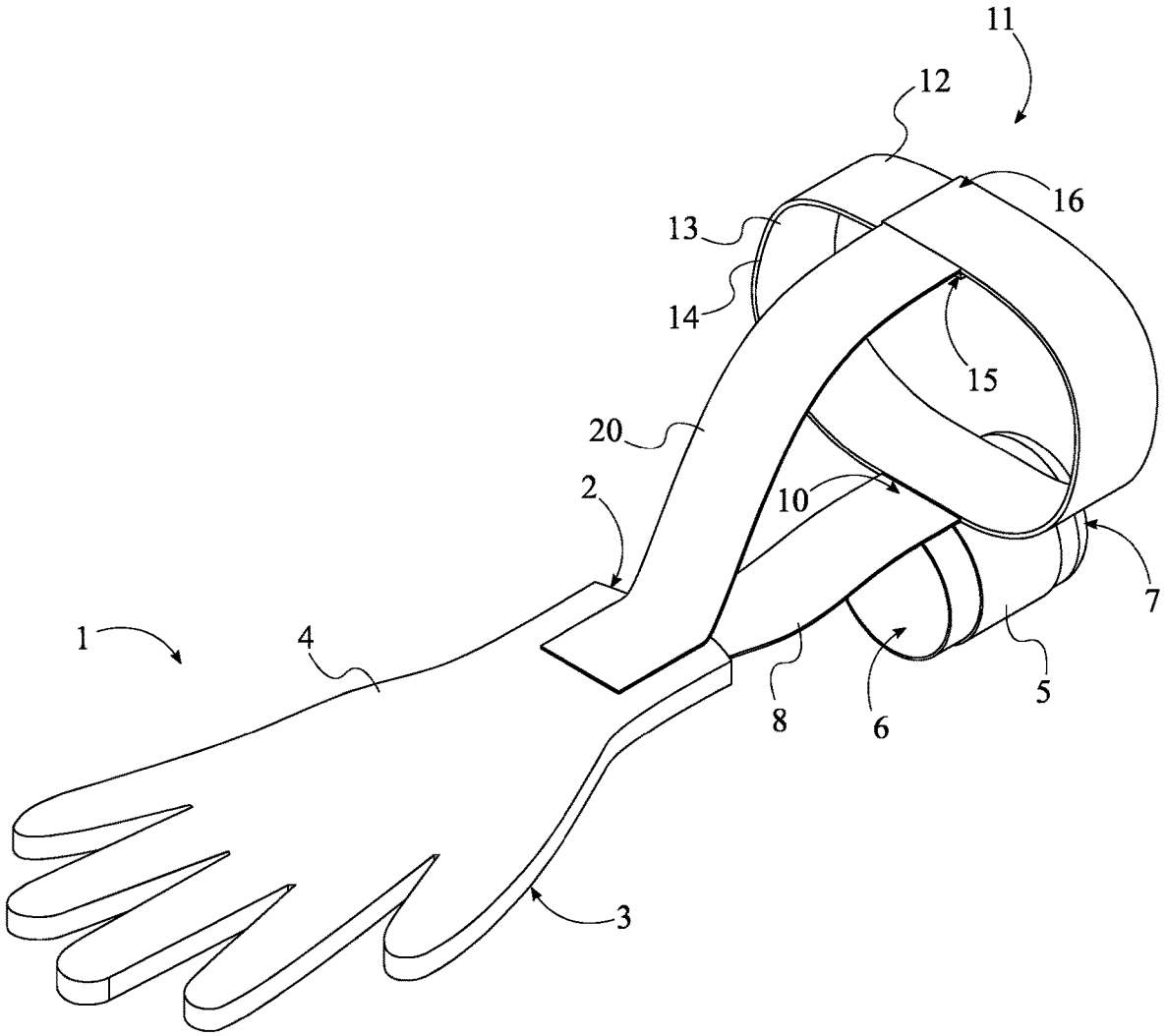
FIG. 5 is a top-front perspective view showing the present invention, wherein the armband is fastened and tethered to the work glove by the supporting strap.

To provide additional support to the user while performing physical activities using a handheld tool, the present invention may further comprise an armband 11 that secures the bracing socket 5 to the user's forearm. As can be seen in FIGS. 2 and 5, the armband 11 is preferably a flexible band that can be fastened around a portion of the user's forearm, to fasten the bracing socket 5 against the user's forearm and to give more control to the user while maneuvering the handheld tool. The armband 11 may comprise an outer band surface 12 and an inner band surface 13 due to the thin planar structure of the armband 11. In addition, the bracing socket 5 is mounted onto the outer band surface 12. Thus, when the user fastens the armband 11 to their forearm, the inner band surface 13 is positioned against the user's forearm, while the outer band surface 12 is oriented away from the user's arm. Thus, the bracing socket 5 is safely secured to the user's forearm without impeding the user from inserting the end of the tool handle into the bracing socket 5.

To facilitate the fastening of the armband 11 to the user's arm, the present invention may further comprise a length-adjusting fastener 17. As can be seen in FIGS. 1, 3, and 4, the length-adjusting fastener 17 enables the user to secure the armband 11 to different portions of the user's forearm. The armband 11 may further comprise a band body 14, a first band end 15, and a second band end 16. The band body 14 corresponds to the flat, elongated structure of the armband 11 with the first band end 15 and the second band end 16 corresponding to the terminal ends of the band body 14. The length-adjustable fastener also comprises a first fastener portion 18 and a second fastener portion 19. The first fastener portion 18 and the second fastener portion 19 may correspond to the male portion and the female portion of a fastener such as a hook and loop fastener, a snap fastener, or a button fastener. The first band end 15 is positioned opposite to the second band end 16 along the band body 14 due to the elongated structure of the band body 14. The first fastener portion 18 is mounted onto the outer band surface 12, adjacent to the first band end 15. Similarly, the second fastener portion 19 is mounted onto the inner band surface 13, adjacent to the second band end 16. Thus, as the first fastener portion 18 is engaged along the second fastener portion 19, and the fastened band body 14 forms a closed loop around the user's forearm. The user can just adjust the tightness by disengaging the first fastener portion 18 from the second fastener portion 19, and then reengaging the first fastener portion 18 with the second fastener portion 19 at a different location along the second fastener portion 19. Furthermore, the bracing socket 5 is positioned offset to the first band end 15 along the band body 14 to leave enough functional space between the first band end 15 and the bracing socket 5. Likewise, the bracing socket 5 is positioned offset to the second band end 16 along the band body 14. Thus, the bracing socket 5 can be centered on the outer band surface 12.

Figure 6:
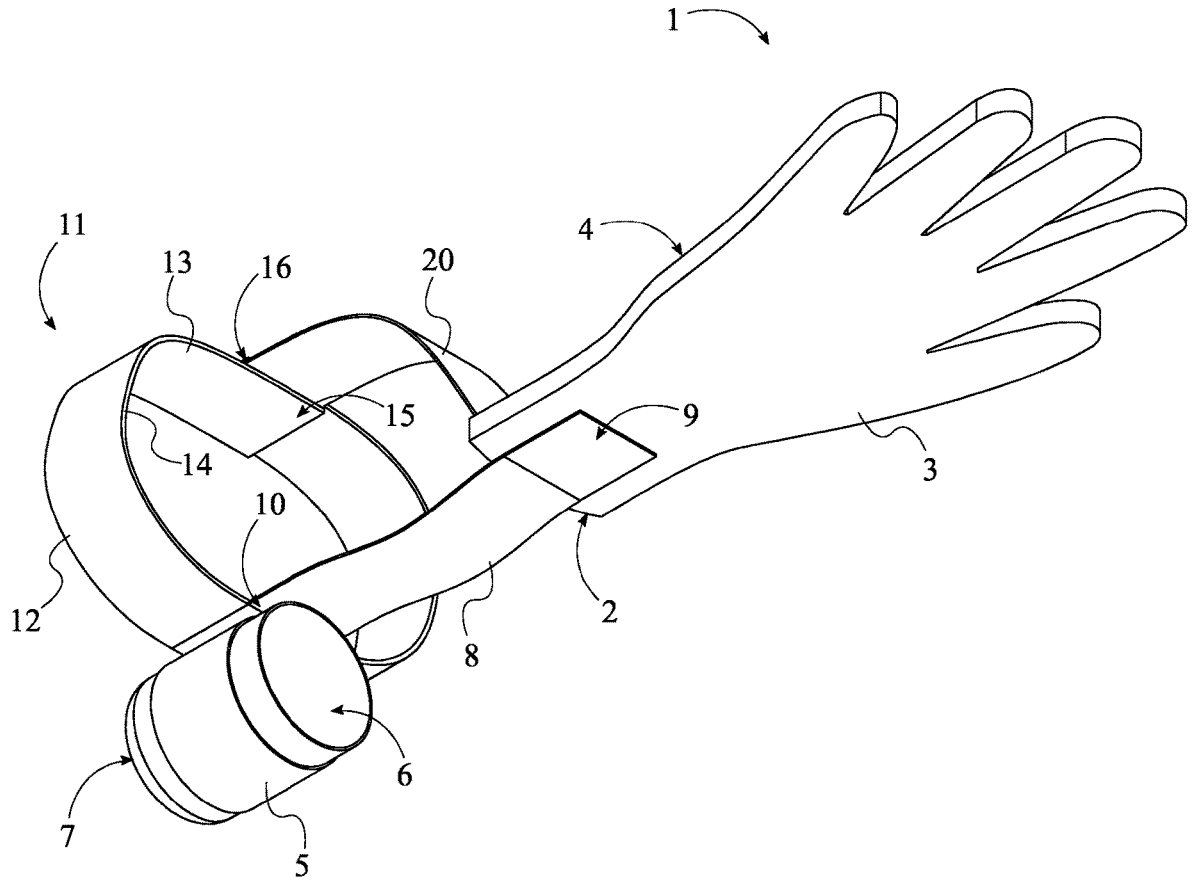
FIG. 6 is a bottom-front perspective view showing the present invention.

The present invention can include various safety features that make wearing the armband 11 very comfortable while also minimizing the load on the user's hand. As can be seen in FIGS. 1, 5, and 6, the present invention may further comprise a supporting strap 20 that connects the armband 11 to the work glove 1. The supporting strap 20 is preferably a thin strap with a length that maintains the armband 11 at an optimal distance from the work glove 1. The armband 11 is tethered to the work glove 1 by the supporting strap 20 so that the armband 11 is directly connected to the work glove 1 and not just indirectly connected by the offsetting strap 8 and the bracing socket 5. In other embodiments, the supporting strap 20 can be the remainder of the first band end 15 after the first fastener portion 18 has been engaged with the second fastener portion 19.

Figure 7:
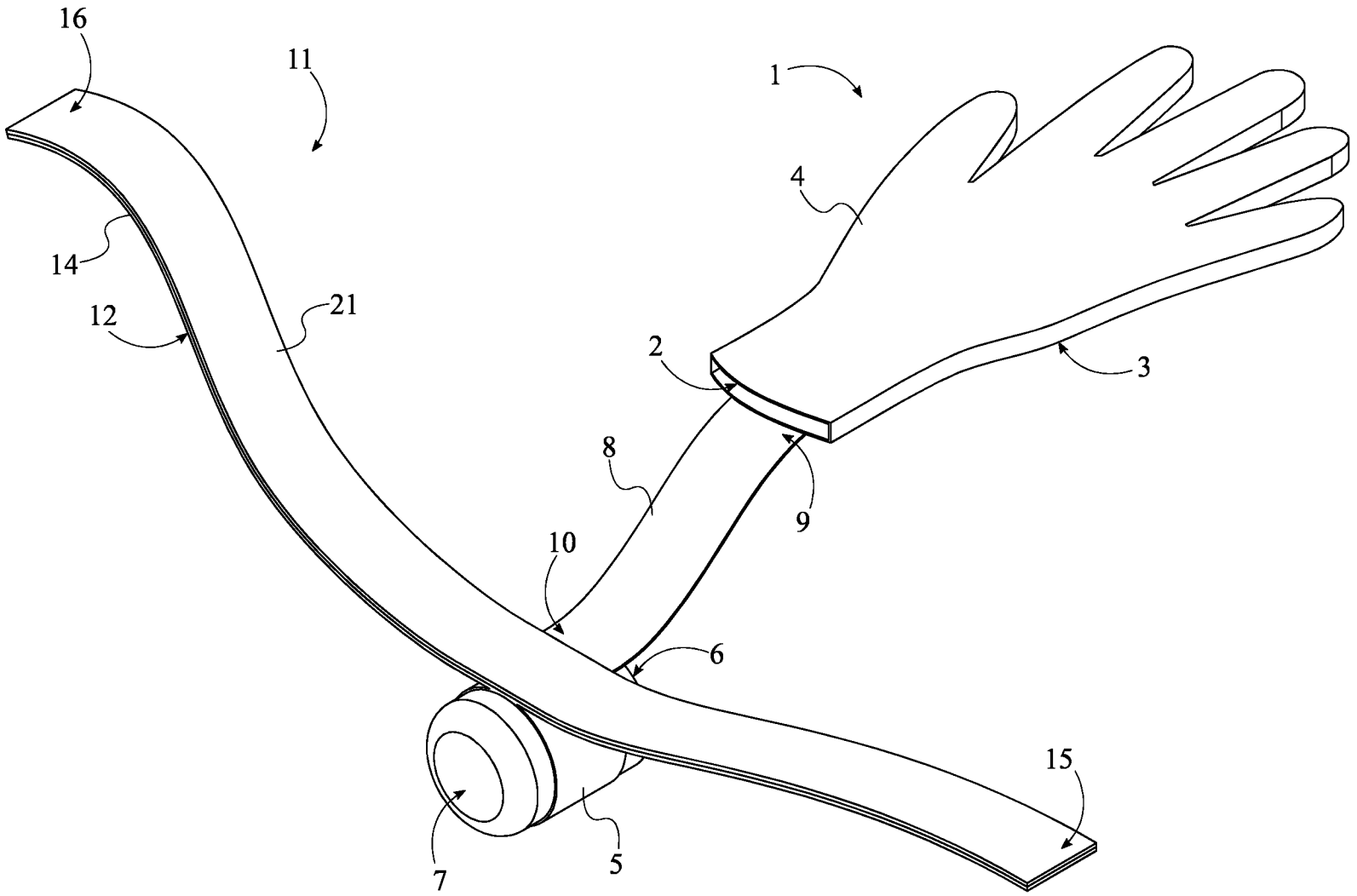
FIG. 7 is a top-rear perspective view showing the present invention, wherein the inner band surface of the armband is shown covered by padding.

In addition to the supporting strap 20, the present invention may further comprise a padding 21 to help the armband 11 be more comfortable to wear while handling heavy loads on the handheld tool. As can be seen in FIG. 7, the padding 21 is used to lessen the strain on the user's forearm from the load or to prevent any injury that may be caused by friction between the inner band surface 13 and the arm skin. The padding 21 is integrated into the inner band surface 13 to protect the user's skin. For example, the padding 21 can be made of foam material that is distributed along the inner band surface 13. Alternatively, the padding 21 can be replaced with an inflatable structure that can be selectively inflated to soften the load on the user's arm.

Figure 8:
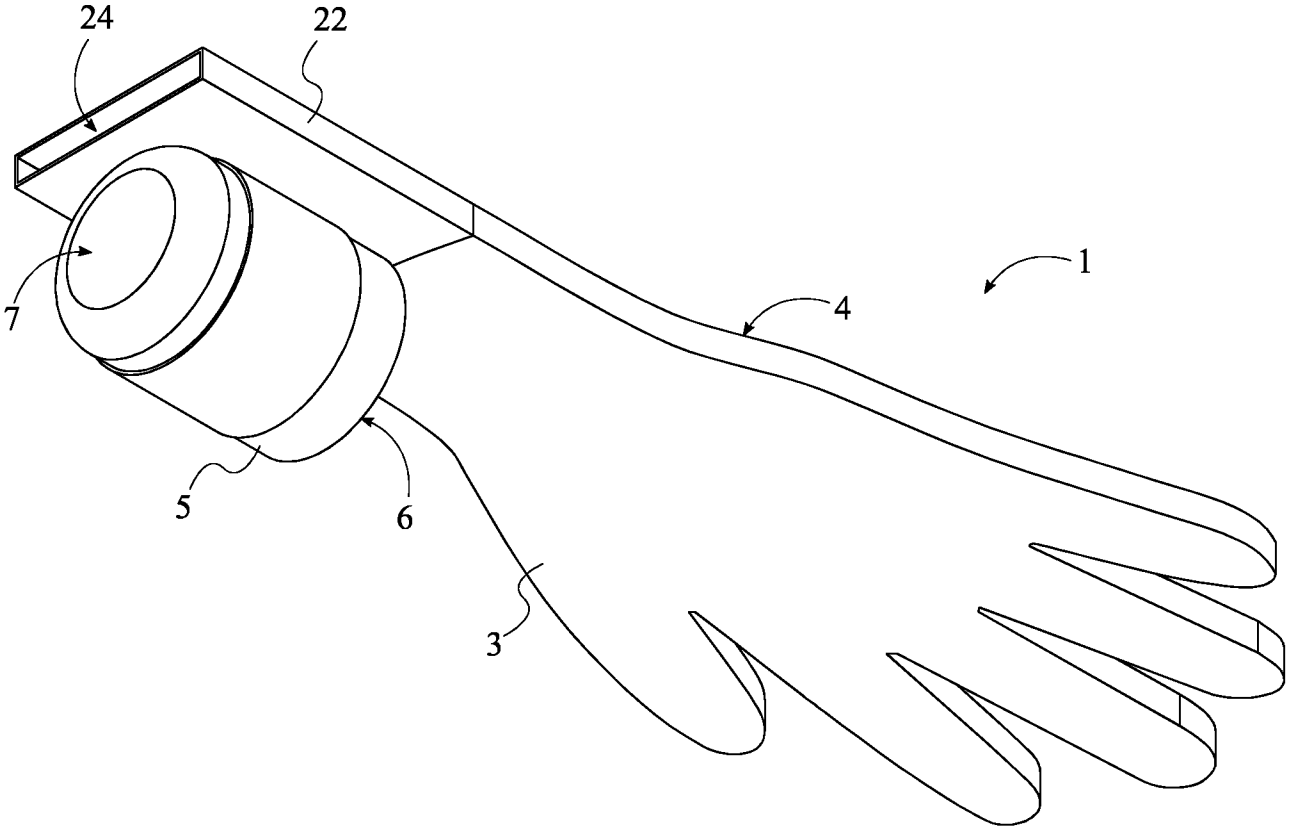
FIG. 8 is a bottom-rear perspective view showing the present invention, wherein the work glove is shown with an extension sleeve.
Figure 9:
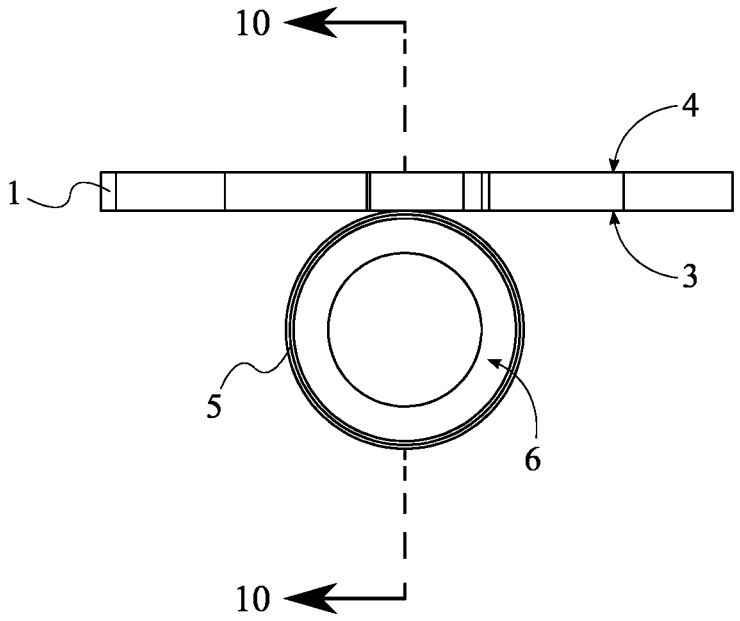
FIG. 9 is a front view showing the present invention, wherein the bracing socket is shown connected to the extension sleeve.

Furthermore, in some embodiments, the bracing socket 5 can be directly connected onto the work glove 1. As can be seen in FIG. 8 through 10, the present invention may further comprise an extension sleeve 22 that elongates the structure of the work glove 1. The extension sleeve 22 comprises a first open sleeve end 23 and a second open sleeve end 24 due to the open-ended structure of the extension sleeve 22 that matches the structure of the work glove 1. The first open sleeve end 23 is positioned opposite to the second open sleeve end 24 along the extension sleeve 22 due to the length of the extension sleeve 22. Further, the first open sleeve end 23 is connected around the wrist opening 2 to connect the extension sleeve 22 to the work glove 1. In addition, the bracing socket 5 is laterally connected to the extension sleeve 22, adjacent to the second open sleeve end 24. Thus, the bracing socket 5 is still positioned offset from the wrist opening 2, opposite to the palmar portion 3 to minimize the load on the user's hand. In other embodiments, the bracing socket 5 can be positioned offset from the wrist opening 2 utilizing different means.

Although the invention has been explained in relation to its preferred embodiment, it is to be understood that many other possible modifications and variations can be made without departing from the spirit and scope of the invention as hereinafter claimed.

What is claimed is:

1. A load-assisting glove comprising:
a work glove;
a bracing socket;
the work glove comprising a wrist opening, a palmar portion, and a dorsal portion;
the bracing socket comprising an open socket end and a closed socket end;
the palmar portion being positioned opposite to the dorsal portion about the work glove;
the wrist opening being positioned in between the dorsal portion and the palmar portion;
the bracing socket being mounted offset from the wrist opening, opposite the dorsal portion;
the open socket end being oriented towards the work glove; and,
the closed socket end being oriented away from the work glove.

2. The load-assisting glove as claimed in claim 1 comprising:
an offsetting strap; and,
the bracing socket being tethered to the work glove by the offsetting strap.

3. The load-assisting glove as claimed in claim 2 comprising:
the offsetting strap comprising a first strap end and a second strap end;
the first strap end being positioned opposite to the second strap end along the offsetting strap;
the first strap end being externally connected onto the palmar portion; and,
the second strap end being laterally connected to the bracing socket.

4. The load-assisting glove as claimed in claim 1 comprising:
an armband;
the armband comprising an outer band surface and an inner band surface; and,
the bracing socket being mounted onto the outer band surface.

5. The load-assisting glove as claimed in claim 4 comprising:
a length-adjusting fastener;
the armband further comprising a band body, a first band end, and a second band end;
the length-adjusting fastener comprising a first fastener portion and a second fastener portion;
the first band end being positioned opposite to the second band end along the band body;
the first fastener portion being mounted onto the outer band surface, adjacent to the first band end;
the second fastener portion being mounted onto the inner band surface, adjacent to the second band end; and,
the first fastener portion being engaged along the second fastener portion.

6. The load-assisting glove as claimed in claim 5 comprising:
the bracing socket being positioned offset to the first band end along the band body; and,
the bracing socket being positioned offset to the second band end along the band body.

7. The load-assisting glove as claimed in claim 4 comprising:
a supporting strap; and,
the armband being tethered to the work glove by the supporting strap.

8. The load-assisting glove as claimed in claim 4 comprising:
a padding; and,
the padding being integrated into the inner band surface.

9. The load-assisting glove as claimed in claim 1 comprising:
an extension sleeve;
the extension sleeve comprising a first open sleeve end and a second open sleeve end;
the first open sleeve end being positioned opposite to the second open sleeve end along the extension sleeve;
the first open sleeve end being connected around the wrist opening; and,
the bracing socket being laterally connected to the extension sleeve, adjacent to the second open sleeve end.

10. A load-assisting glove comprising:
a work glove;
a bracing socket;
an offsetting strap;
the work glove comprising a wrist opening, a palmar portion, and a dorsal portion;
the bracing socket comprising an open socket end and a closed socket end;
the palmar portion being positioned opposite to the dorsal portion about the work glove;
the wrist opening being positioned in between the dorsal portion and the palmar portion;
the bracing socket being mounted offset from the wrist opening, opposite the dorsal portion;
the open socket end being oriented towards the work glove;
the closed socket end being oriented away from the work glove; and,
the bracing socket being tethered to the work glove by the offsetting strap.

11. The load-assisting glove as claimed in claim 10 comprising:
the offsetting strap comprising a first strap end and a second strap end;
the first strap end being positioned opposite to the second strap end along the offsetting strap;
the first strap end being externally connected onto the palmar portion; and,
the second strap end being laterally connected to the bracing socket.

12. The load-assisting glove as claimed in claim 10 comprising:
an armband;
the armband comprising an outer band surface and an inner band surface; and,
the bracing socket being mounted onto the outer band surface.

13. The load-assisting glove as claimed in claim 12 comprising:

a length-adjusting fastener;

the armband further comprising a band body, a first band end, and a second band end;

the length-adjusting fastener comprising a first fastener portion and a second fastener portion;

the first band end being positioned opposite to the second band end along the band body;

the first fastener portion being mounted onto the outer band surface, adjacent to the first band end;

the second fastener portion being mounted onto the inner band surface, adjacent to the second band end;

the first fastener portion being engaged along the second fastener portion;

the bracing socket being positioned offset to the first band end along the band body; and, the bracing socket being positioned offset to the second band end along the band body.

14. The load-assisting glove as claimed in claim 12 comprising:

a supporting strap; and the armband being tethered to the work glove by the supporting strap.

15. The load-assisting glove as claimed in claim 12 comprising:

a padding; and, the padding being integrated into the inner band surface.

16. A load-assisting glove comprising:

a work glove;

a bracing socket;

an extension sleeve;

the work glove comprising a wrist opening, a palmar portion, and a dorsal portion;

the bracing socket comprising an open socket end and a closed socket end;

the extension sleeve comprising a first open sleeve end and a second open sleeve end;

the palmar portion being positioned opposite to the dorsal portion about the work glove;

the wrist opening being positioned in between the dorsal portion and the palmar portion;

the bracing socket being mounted offset from the wrist opening, opposite the dorsal portion;

the open socket end being oriented towards the work glove;

the closed socket end being oriented away from the work glove;

the first open sleeve end being positioned opposite to the second open sleeve end along the extension sleeve;

the first open sleeve end being connected around the wrist opening; and, the bracing socket being laterally connected to the extension sleeve, adjacent to the second open sleeve end.

* * * * *